United States Patent [19]

Humphrey

[11] Patent Number: 5,033,451

[45] Date of Patent: Jul. 23, 1991

[54] FLUID FLYWHEEL

[76] Inventor: Robert A. Humphrey, 11808 Stannary Pl., Raleigh, N.C. 27613

[21] Appl. No.: 556,313

[22] Filed: Jul. 23, 1990

[51] Int. Cl.[5] ..... F24C 9/00

[52] U.S. Cl. ..... 126/247; 122/26; 237/1 R

[58] Field of Search ..... 126/247; 122/26; 237/1 R; 415/501, 199.4

[56] References Cited

U.S. PATENT DOCUMENTS

| | | | |
|---|---|---|---|
| 3,297,019 | 1/1967 | Lawson | 126/247 |
| 4,089,322 | 5/1978 | Guibert | 126/21 A X |
| 4,454,861 | 6/1984 | Grenier | 126/247 |
| 4,678,400 | 7/1987 | Kuboyama | 126/247 X |

FOREIGN PATENT DOCUMENTS

| | | | |
|---|---|---|---|
| 209512 | 7/1963 | U.S.S.R. | 122/26 |
| 615327 | 7/1978 | U.S.S.R. | 126/247 |

*Primary Examiner*—Larry Jones

*Attorney, Agent, or Firm*—Rhodes, Coats, & Bennett

[57] ABSTRACT

A single stage energized fluid-flywheel comprises two concentric housings defining a main circulation chamber and an annular recirculation chamber surrounding the main circulation chamber. An axially extending shaft is rotatably mounted in the outer housing and has a series of blades mounted thereon. Upon rotation of the shaft, fluid is drawn by the blades into the inlet end of the main circulation chamber. The fluid is propelled from one series of blades to the next until it is discharged from the outlet end. The fluid is then redirected around the inner housing and recirculated through the recirculation chamber. The fluid, being constantly recirculated within the device will increase in speed or maintain the existing speed with relatively minimal force being applied to rotate the axially extending shaft. Toroidal shaped flow deflectors at opposing ends of the fluid flywheel facilitate smooth transition of fluid from the main circulation chamber to the recirculation chamber and vice versa.

10 Claims, 2 Drawing Sheets

FLUID FLYWHEEL

BACKGROUND OF THE INVENTION

This invention relates to a fluid device utilizing recirculated fluid within a sealed housing to maintain speed or torque applied to a mechanical apparatus without relying on weight for inertia.

Typically, a flywheel comprises a relatively heavy, rotating wheel used to minimize speed variation in a machine subject to fluctuation in drive and load. Rotary fluid devices have been used for essentially the same purpose with only questionable effectiveness. One such device is shown in the patent to Pelto, U.S. Pat. No. 4,406,121, which discloses a multiple stage fluid flywheel. The device disclosed in the patent to Pelto is an overcomplicated assembly including multiple stages and many moving parts. Devices of this general type are generally inefficient due to increased drag produced by the moving fluid.

The present invention is a rotary fluid device which overcomes the disadvantages of prior art devices. The fluid device comprises two concentric housings defining a main circulation chamber and an annular recirculation chamber surrounding the main circulation chamber. The inner housing is mounted on an axially extending shaft which extends through the outer housing. The shaft is rotated by an outside source of energy. The shaft is also connected to a driven device directly or by a clutch mechanism to perform useful work.

Upon rotation of the shaft, the fluid within the device is continuously circulated by blades mounted on the shaft. The fluid is drawn into and circulated through the main circulation chamber defined by the inner housing. After reaching the outlet end of the inner housing, a flow deflector at the outlet end redirects the fluid through the recirculation chamber back towards the inlet end. A second flow deflector at the inlet end directs the fluid back into the main circulation chamber. The fluid impinging upon the blades from behind assists the rotation of the shaft. Thus, increases in speed are more easily obtained due to the reaction of the fluid against each group of blades. The fluid device also resists speed degeneration and modulates fluctuations in speed due to instantaneous variations in the drive and load.

Accordingly, a primary object of the present invention is to provide a rotary fluid device which utilizes the momentum of a moving fluid to improve the efficiency of operation of a machine.

Another object of the present invention is to provide a rotary fluid device for use as a flywheel to minimize speed variation in a machine.

Yet another object of the present invention is to provide a rotary fluid device which is relatively simple in construction and has a minimum number of moving parts.

DETAILED DESCRIPTION OF THE INVENTION

Figure 1:
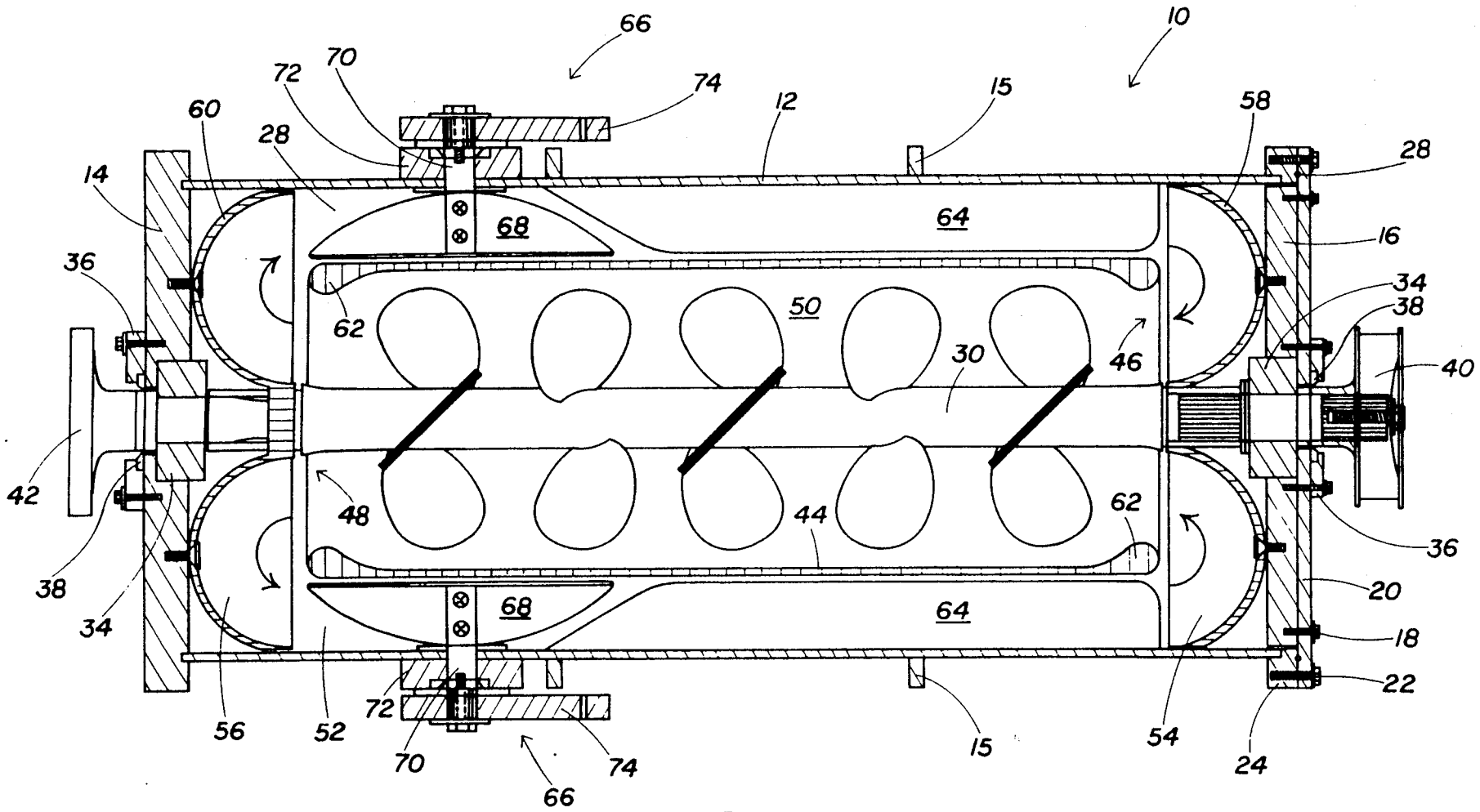
FIG. 1 is a longitudinal section view of the fluid flywheel of the present invention.
Figure 2:
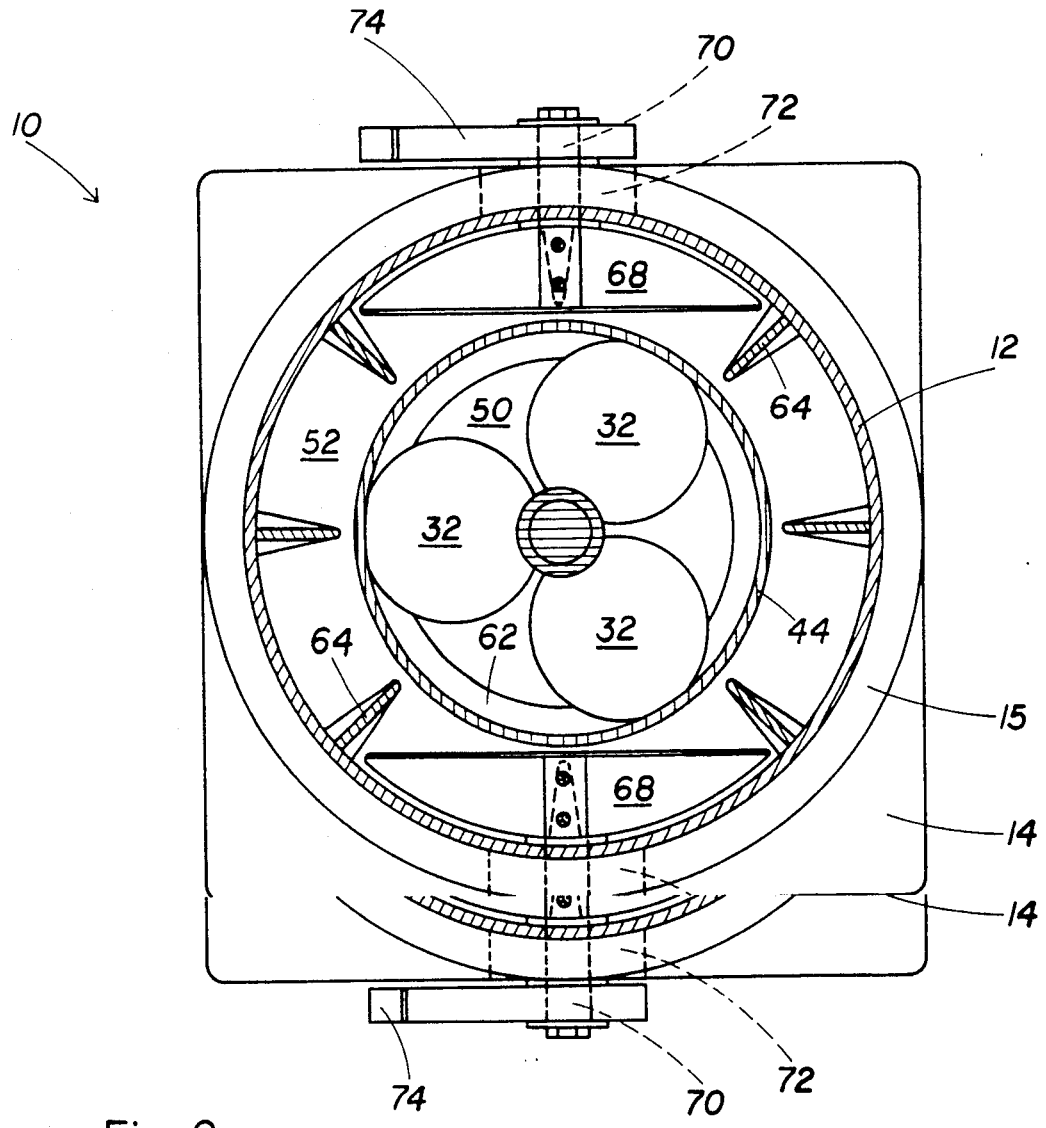
FIG. 2 is a cross-section of the fluid flywheel.

Referring now to the drawings, the fluid flywheel of the present invention is shown therein and indicated generally by the numeral 10. The fluid flywheel 10 includes an outer housing 12 and inner housing 44 which are typically cylindrical in shape. The inner housing 44 is concentrically disposed within the outer housing 12. End plates 14 and 16 are fixedly secured at opposite ends of the outer housing 12. End plate 14 is permanently fixed to the outer housing 12 by means such as welding. The opposite end plate 16 is removable to allow access into the fluid flywheel 10. More particularly, the end plate 16 is secured by bolts 18 to an outer plate 20. The outer plate 20 is, in turn, secured by bolts 22 to a flange 24 which is welded to the outer housing 12. An o-ring seal 26 is clamped in a groove between the flange 24 and outer plate 20. Thus, the outer housing 12 forms a sealed reservoir for containing a fluid 28 such as a light-weight oil.

Extending axially through the outer housing 12 is a shaft 30 which includes a series of angled blades 32 permanently fixed thereto. The shaft 30 is rotatively journaled in bearings 34 fixed to each end plate. The bearings 34 would typically be of a self-aligning, low-friction type. To prevent fluid 28 from leaking around the shaft 30, a pair of seals 38 are disposed around the shaft 30 at each end and are clamped in place by seal rings 36.

The shaft 30 has means at one end, such as a clutch mechanism or pulley 40, to connect the shaft 30 to an external power source such as an electric motor. The opposite end of the shaft 30 utilizes a flange, pulley or clutch device 42 to connect the shaft 30 to a mechanical apparatus to perform useful work.

The inner housing is open at both ends and defines a main circulation chamber 50. One end of the inner housing 44 is hereinafter designated as the inlet end 46, the opposite end is designated as the outlet end 48. The annular space between the inner and outer housing serves as a recirculation chamber 52 to direct fluid from the outlet end 48 of the inner housing 44 to the inlet end 46. In the preferred embodiment of the invention, the inner housing 44 is fixedly secured to the blades 32 of the shaft 30 by weldment.

Upon rotation of the shaft 30, the fluid 28 is drawn by blades 32 into the main circulation chamber 50. Fluid 28 is forced from one group of blades to the next until it is finally discharged from the outlet end 48. The fluid is then forced by pressure through the recirculation chamber 52 back towards the inlet end 46.

The present invention is designed to make a smooth transition of the fluid 28 from the recirculation chamber 52 to the main circulation chamber 50 and vice versa so that the momentum of the moving fluid will assist the rotation of the shaft 30. Toroidal shaped flow deflectors 58 and 60 are disposed in the transition areas 54 and 56 at opposite ends of the outer housing 12. The first flow deflector 58 directs fluid from the recirculation chamber 52 into the inlet end 46 of the main circulation chamber 50. The second flow deflector 60 directs the fluid from the outlet end of the main circulation chamber 50 into the recirculation chamber 52. In addition, both the inlet and outlet ends 46 and 48 of the inner housing 44 are formed with bulb-like enlargements 62. The bulb-like enlargements 62, in combination with the flow deflectors 58 and 60, minimizes turbulence as the fluid makes a transition from the main circulation chamber 50 to the recirculation chamber 52 and vice versa. Further, the enlargements and flow deflectors prevent dead pockets or eddies from forming in the moving fluid.

Because of the momentum of the recirculated fluid, the amount of outside force required to rotate the shaft is considerably less than with conventional flywheels. The fluid impinging on the blades 32 from behind helps to rotate the shaft 30 while the fluid immediately forward of the blades 32 is propelled to the next series of blades. The fluid being constantly recirculated within the device 10 will increase in speed or maintain the existing speed with relatively minimal force being applied to rotate the shaft 30.

While not required by the present invention, the fluid flywheel 10 may include a plurality of axially extending fins 64 which are secured by weldment to the inside of the outer housing 12. The fins 64 are provided to eliminate the spiraling of the fluid 28 around the inner housing 44 which rotates with the shaft 30.

The present invention may also include a flow brake assembly 66 to regulate the flow of fluid. The flow brake assembly includes a flow brake blade 68 which can be pivoted on shaft 70. The shaft 70 rotates in a flow brake mount 72 which is secured by weldment to the outer housing 12. A pivot arm 74 connected to the outer end of the shaft 70 may be connected by cable, rod or other mechanical linkage to a control device (not shown). When the flow brake blade 68 extends axially, there is virtually no resistance to the flow of fluid. However, when the flow brake blade 68 is disposed angularly, it creates drag thereby slowing the motion of the circulating fluid 28.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A fluid flywheel comprising:

(a) a generally cylindrical outer housing filled with a liquid;

(b) a generally cylindrical inner housing disposed concentrically within the outer housing so as to define a main circulation chamber within the inner housing and an annular recirculation chamber between the inner and outer housing;

(c) a drive shaft rotatably mounted in the outer housing and extending axially through the inner housing;

(d) means for coupling the drive shaft to a drive means for rotating the drive shaft;

(e) means for coupling the drive shaft to an external driven device, wherein said drive shaft transmits power from said drive means to said driven device;

(f) a plurality of impellers fixed to the drive shaft between the ends thereof and disposed within the main circulation chamber for circulating fluid through the inner housing from the entry end to the outlet end when the drive shaft is rotated wherein the liquid is recirculated from the outlet end of the inner housing towards the inlet end through the outer recirculation chamber;

(g) first and second flow deflectors disposed at opposite ends of the outer housing wherein the first flow deflector directs liquid from the outlet of the main circulation chamber into the recirculation chamber, and wherein the second flow deflector directs liquid from the recirculation chamber into the inlet end of the main circulation chamber so that the momentum of the moving liquid reacts against the impellers to assist rotation of the drive shaft and to moderate speed variation in the drive shaft due to fluctuation in drive or load.

2. The fluid flywheel according to claim 1 wherein the first and second flow deflector each comprise a toroidal shaped end piece.

3. The fluid flywheel according to claim 1 wherein the impeller blades are fixed to the inner surface of the inner housing and the inner housing rotates with the drive shaft.

4. The fluid flywheel according to claim 1 further including a plurality of axially extending flow guides mounted in the annular recirculation chamber for preventing the fluid from spiralling around the inner housing.

5. The fluid flywheel according to claim 1 further including a fluid flow brake for regulating the flow of fluid.

6. The fluid flywheel according to claim 1 further including turbulence reducers disposed at the ends of the inner housing for reducing turbulence as the fluid is deflected by the flow deflectors.

7. The fluid flywheel according to claim 6 wherein the turbulence reducers comprise a rounded, bulb-like enlargement on the respective end of the inner housing.

8. The fluid flywheel according to claim 1 further including reinforcing bands extending circumferentially around the outer housing.

9. A fluid flywheel comprising:

(a) an outer housing;

(b) a liquid contained within the outer housing;

(c) an inner housing open at both ends and disposed within the outer housing, wherein the inner housing defines a main circulation chamber, and wherein the space between the inner and outer housings defines a recirculation chamber;

(d) a drive shaft rotatably mounted in the outer housing;

(e) means for coupling the drive shaft to a drive means for rotating the drive shaft;

(f) means for coupling the drive shaft to an external driven device, wherein said drive shaft transmits power from said drive means to said driven device;

(g) means attached to the drive shaft for propelling the liquid through the main circulation chamber defined by the inner housing;

(h) a first flow deflector means for redirecting the flow of liquid exiting the main circulation chamber into the recirculation chamber to be returned to the inlet end of the main circulation chamber;

(i) a second flow deflector means for redirecting the flow of liquid from the recirculation chamber into the main circulation chamber so that the momentum of the moving fluid reacts with the impellers to assist rotation of the shaft.

10. The fluid flywheel according to claim 9 wherein the first and second flow deflector means each comprise a generally toroidal shaped end piece.

* * * * *